United States Patent [19]

Reed

[11] 4,015,954

[45] Apr. 5, 1977

[54] LAMINAR FLOW FLAME ARRESTOR

[75] Inventor: Robert D. Reed, Tulsa, Okla.

[73] Assignee: John Zink Company, Tulsa, Okla.

[22] Filed: Dec. 29, 1975

[21] Appl. No.: 644,595

[52] U.S. Cl. ..... 48/192; 55/DIG. 20; 60/39.11; 138/37; 138/38; 220/88 A; 431/346

[51] Int. Cl.[2] ..... F17D 3/00

[58] Field of Search ..... 48/192; 55/DIG. 20; 123/142; 60/39.11; 138/41, 37, 38; 220/88 R, 88 A; 222/189; 240/121; 431/346

[56] References Cited

UNITED STATES PATENTS

| | | | |
|---|---|---|---|
| 1,681,698 | 8/1928 | Brooks | 48/192 |
| 1,826,487 | 10/1931 | Wiggins | 48/192 |
| 1,887,305 | 11/1932 | Helmore et al. | 123/142 |
| 2,068,421 | 1/1937 | Long et al. | 220/88 A |
| 2,333,567 | 11/1943 | Helmore | 48/192 |
| 2,772,537 | 12/1956 | Liscioni | 48/192 |
| 2,789,238 | 4/1957 | Staak | 220/88 R |
| 2,850,083 | 9/1958 | Frost | 220/88 R |
| 3,356,256 | 12/1967 | Szego | 220/88 A |

*Primary Examiner*—S. Leon Bashore
*Assistant Examiner*—Peter F. Kratz
*Attorney, Agent, or Firm*—Head, Johnson & Chafin

[57] ABSTRACT

A flame arrester having a rectangular housing of internal width W, length L and heighth H filled with a plurality of contiguous convoluted planar laminae. Each lamina is comprised of a thin sheet of metal formed with a plurality of spaced parallel shallow channels of selected depth D. As the laminae are placed in the housing in parallel contiguous contact to fill the cross-section of the housing, there will be a great plurality of narrow slots of width D through which the gas will pass to the flame area. Means may be provided in the form of shallow protrusions of heighth D pressed into the metal in the flat areas of the sheet in order to insure that the spacing between sheets at all points is close to the value D.

6 Claims, 6 Drawing Figures

LAMINAR FLOW FLAME ARRESTOR

BACKGROUND OF THE INVENTION

As is well known in the art of gaseous combustion, in a volume of mixed combustible gas and air, flame will progress through the gas air mixture according to a certain velocity of propagation of the flame front. When the gas issues from a burner nozzle, the velocity of the gas mixture must be greater than the velocity of the flame front, so that the flame will always remain at a minimum distance from the surface of the burner. If the flow rate of gas reduces to a value less than the velocity of the flame front, the flame will progress upstream of the gas and may enter the burner. Combustion will then occur within the burner structure with consequent damage and danger to the equipment.

To prevent this progress of the flame front upstream of the gas flow, a structure is provided which is well known as a flame arrester, which generally comprises a structure having a plurality of small channels through which the gas flows. The walls of the channels are metal and are nominally at a temperature which is well below the ignition temperature of the gas. As flame tends to move upstream of the gas issuing from the arrester and into the interstices of the arrester, it will be cooled to a temperature below the combustion point, and the gas flame will be extinguished. The condition known as "flashback" in burners is an example of undesirable flame front movement.

Air is the typical source of oxygen for fuels burning. Therefore, in mixtures of air with typical non-detonative fuels and in typical burner operation, the flow velocity of the air-fuel mixture is greater than the velocity of the flame propagation, and flashback cannot occur. Detonative fuels are, for example, hydrogen, acetylene, ethylene oxide, carbon disulphide. With these fuels, flame arrest is impossible, unless a water seal is used, because of greatly excessive velocity of the flame front. Typical flame arresters, which are labyrinthine in structure, are therefore of no use with detonative fuels. Non-detonative fuels are typically hydrocarbon derivatives, C0 and the like, or more specifically the standard fuels of commerce and industry.

There are many cases where flame arrest is demanded for safety or for operations. Perhaps the first instance of useful flame arrest is to be found in what is called a "miner's lamp", as invented by Sir Humphrey Davy. In this device a metallic screen surrounds the flame of the lamp. When the lamp is within an atmosphere which is so laden with combustible gases as to be explosive upon contact with the flame, the metallic screen, which is interposed between the flame of the lamp and the explosive atmosphere, very rapidly chills the flame due to burning of combustible gas inside the screen so that flame created ignition temperature of the combustible gas cannot exist outside the screen, and no combustible burning or explosion can occur. Those versed in the arts know that the action of the flame arrester is due to simple flame front chilling to a temperature less than the ignition temperature of the fuel, and burning is thus checked. There is little danger of flashback in normal air-fuel flow operations. However, danger of flashback increases rapidly as flow velocity of the gas-air mixture is decreased, and is greatest when all fuel-air flow stops.

In the prior art the conventional type of flame arrester is cylindrical in shape, and involves a construction utilizing a plurality of cylindrical sheets with a corrugated thin sheet of metal inserted between each of the sheets, so as to form a large multiplicity of channels of triangular cross-section. Because of the large volume of metal involved in that type of structure, the cross-section for air passage is normally no more than 30% of the area of the flame arrester. Furthermore, because of the cylindrical construction, the shape is such as to provide poor space conservation. Consequently, the current present day flame arresters are large and bulky and have high pressure drop.

SUMMARY OF THE INVENTION

It is the primary object of this invention to provide a flame arrester which has minimal volume and minimum pressure drop for the flow of fuel-air mixture.

This and other objects are realized, and the limitations of the prior art are overcome in this invention by providing a rectangular construction for the flame arrester. There is a rectangular housing which is filled with laminae, each lamina comprising a thin sheet of metal which is formed with a plurality of spaced apart, parallel, shallow, rectangular depressions of a selected depth D. As these plates are stacked one against the other to fill the space inside the housing, the cross-sections of the fuel-air passages are in the form of narrow slots of length equal to the length of the sheets.

BRIEF DESCRIPTION OF THE DRAWINGS

These and other objects and advantages of the invention, and a better understanding of the principles and details of the invention, will be evident from the following description, taken in conjunction with the appended drawings, in which.

DESCRIPTION OF THE PREFERRED EMBODIMENT

Figure 1:
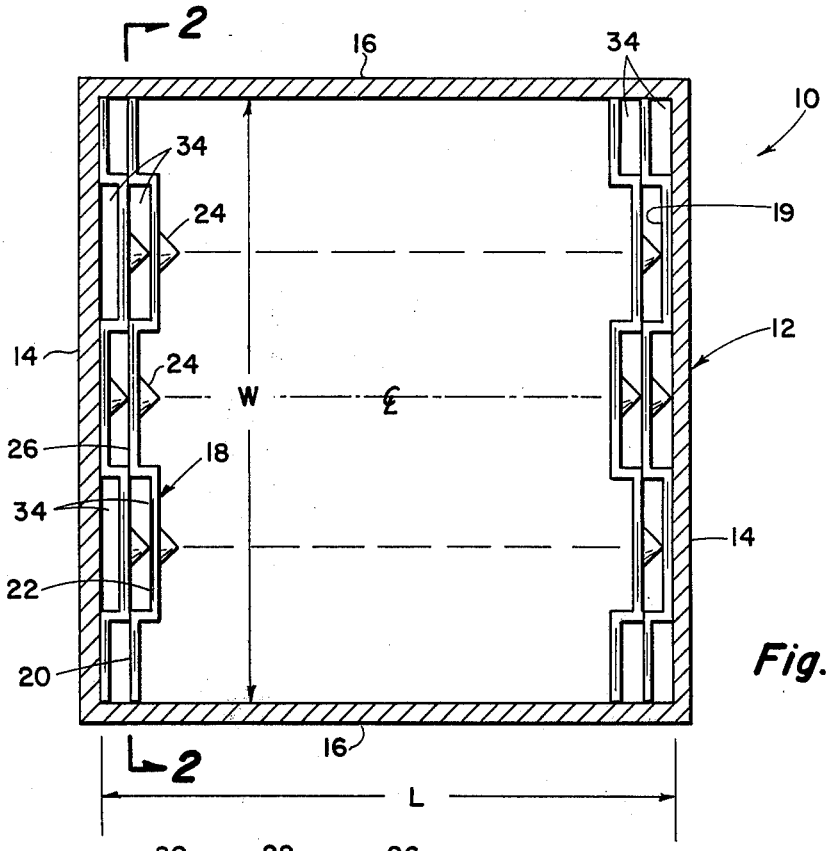
FIGS. 1 and 2 represent plan and elevation cross-sections of one embodiment of the device.
Figure 2:
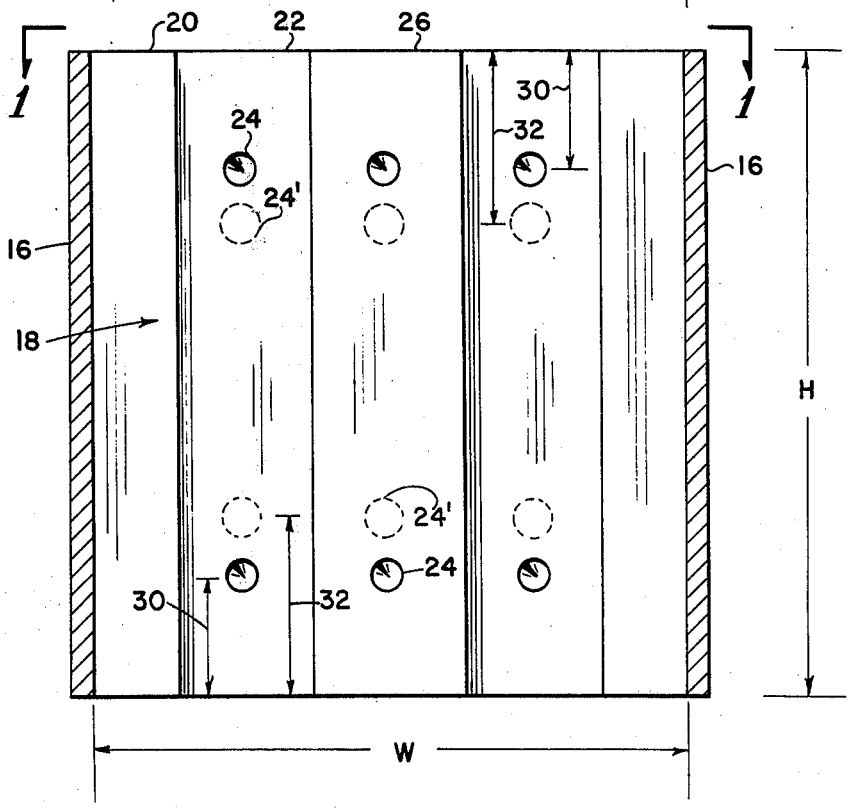

Referring now to the drawings and in particular to FIGS. 1 and 2 there is shown a cross-section of the flame arrester taken along plane 1—1 of FIG. 2 and an elevation section taken along the plane 2—2 of FIG. 1. The flame arrester indicated generally by the numeral 10 comprises a rectangular housing which is formed of sheet metal, having two opposite sides 14 of equal dimension, and another two opposite sides 16 of equal dimension, which may or may not be equal to the dimension of 14. Assume that the inner dimension of wall 14 is W, the internal dimension of wall 16 is L, and the length of the housing is H.

There are a plurality of laminae, indicated generally by the numeral 18, of width W and length H which are stacked inside of the housing as indicated in FIG. 1.

Figure 4:
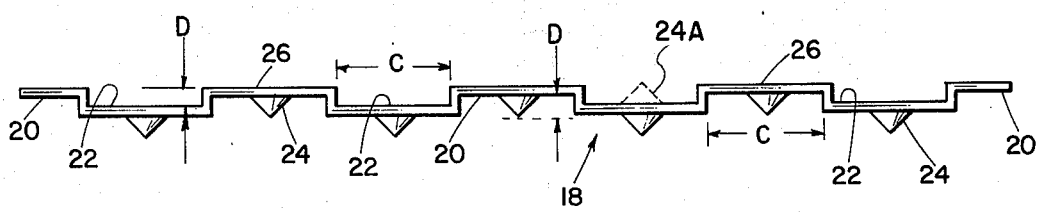
FIGS. 3 and 4 represent elevation and plan views of one lamina.
Figure 3:
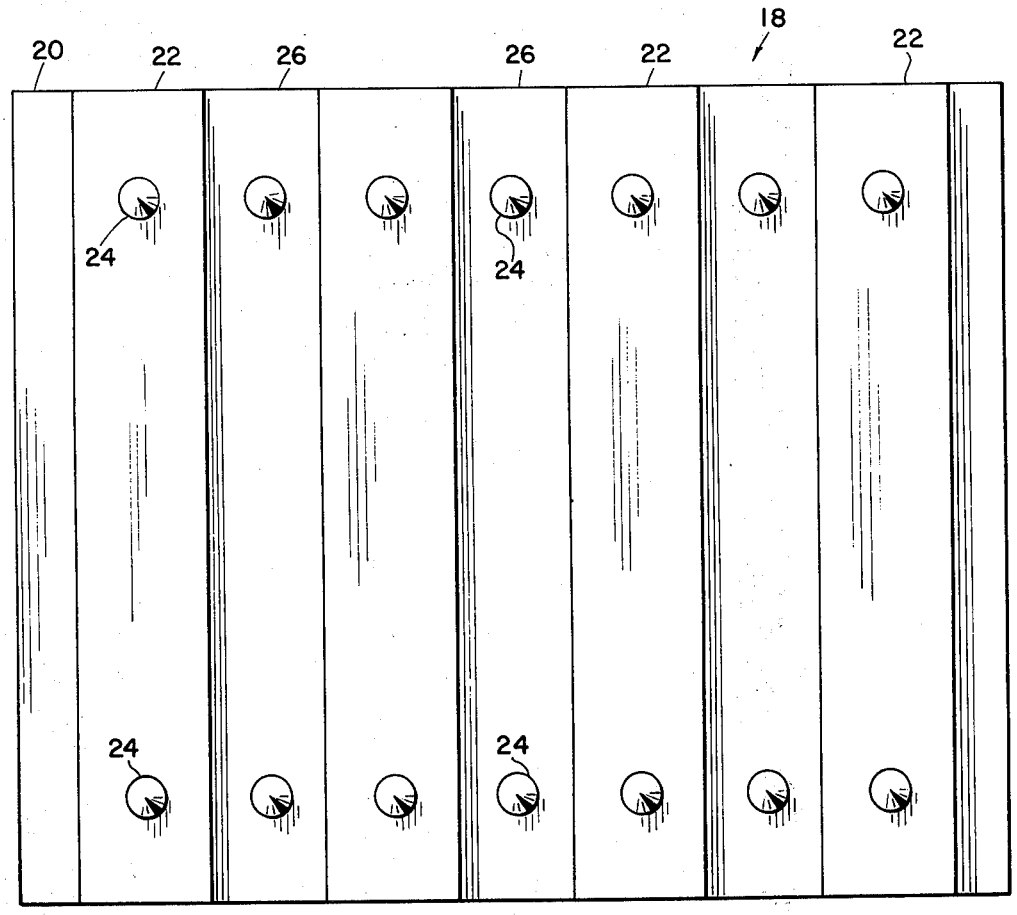

Referring to FIGS. 3 and 4, the detail of a single lamina is shown. They are formed of a sheet of metal of selected thickness, which should be a minimum value which will also have a suitable stiffness. There are a plurality of rectangular channels 22 which are formed in the sheet, separated by portions 26 of the original plane surface of the sheet 20. The depth of the channel D is a selected dimension. The width of the channels C is also of selected value as will be explained below.

Figure 5:
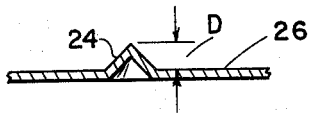
FIG. 5 represents a detail of the formed pyramidal spacers which separate the sheets.

As indicated in FIG. 5, there are a plurality of indentations in the sheet 20, which form protrusions on the opposite side, of convex pyramidal shape 24, of selected heighth D, equal to that of the depth of the channels 22.

Referring back to FIG. 1, it is seen that as the sheets are positioned in contact with each other within the housing, that the legs of the channels will be pressed into contact, and will provide spaced rectangular openings 34 which are of the width D which has been selected for the depth of the channel. The presence of the indentations and pyramids 24 is indicated to keep the spacing equal to the value D throughout the width C of the plane portions of the channels and of the original intervening portions of the sheets. The use of such spacers as 24, which could of course be in other forms, such as hemispherical or any other shape, will serve to maintain a selected value of D for the spacing of the narrow slots 34, that are formed when the laminae are packed into the interior of the housing. It will be clear of course that the last sheet 19, which is in contact with the wall 14, must not have the projections 24. In this sense, last lamina 19 is different from the others.

It would of course be possible to reverse the direction of the spacers 24 in the channel 22 compared to the intermediate portions 26 as shown as 24A in FIG. 4, and then all of the laminae would be identical. However, this may involve a greater cost in the preparation of the laminae.

The width C of the channels 22 and the intermediate spaces 26, is selected such that the slots 34 will be of a length C which is not too great to prevent the adequate cooling of the flame front if it should try to move through the slots. It is well known in the art that a narrow slot of width D across the full width W between the two sheets would not be suitable. Therefore the construction using a plurality of spaced parallel channels is preferred. It also provides a more rigid type of construction since there are points of contact of the laminae at each edge of the channels. This helps to provide the desired constant spacing.

Referring again to FIG. 2, which shows the elevation view, and particularly the view of the spacers 24, it will be clear that on alternate sheets the positions of the spacers 24 must be changed so that the spacer on one lamina does not fit into the depression of the other spacer on the adjacent lamina. Consequently, the spacer should be positioned at a different distance 32 from the edge of the laminae than the distance 30 of the spacer on the intermediate sheets.

It will be clear that if the sheets 18 are symmetrical about the center line of the sheet, then the position of the spacers 24 can be a distance 30 from one end and a distance 32 from the other end. Then, alternate sheets can be turned end for end, to provide the desired effect of the spacers not being opposite each other on adjacent sheets. Thus all sheets can be identical and still have the desired condition.

Once the dimension C of the width of the channels is decided on, and therefore the length of the slots it is desirable to make all of the channels and the intervening spaces of the same width and therefore the sheets could be made symmetrical without any further expense.

Figure 6:
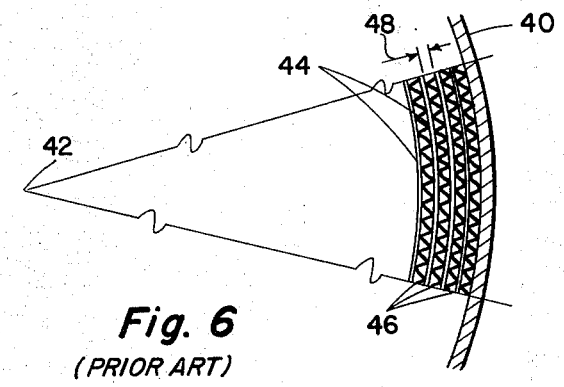
Fig. 6 (PRIOR ART)
FIG. 6 represents the prior art type of construction.

Referring now to FIG. 6, which is an illustration of the prior art construction, the flame arrester would normally be in a circular cylindrical shape, with a wall 40 and a center or axis 42. There would be a large plurality of thin sheets of metal 44 in a cylindrical shape, interspersed with corrugated thin sheets of metal 46. These would form triangular ports for the flow of gas and air mixture. This structure creates a gas flow area which is approximately 30% of the area of the entire flame arrester structure. This compares with a figure of 40% open flow area for the embodiment shown in FIGS. 1 and 2. The pressure drop in gas passage through the rectangular structure of FIGS. 1 and 2 is only 56% of the pressure drop in the triangular port configuration shown in FIG. 6.

Furthermore, with the square construction as shown in FIGS. 1 and 2, that is, with equal width and length, if the width and length should be equal to the diameter of the round form, the free flow area in the square form would be approximately 1.3 times the free flow area of the round form. With the square form rather than the round form, the actual free flow area is 0.4 times 1.3 or approximately 51% greater open flow area compared to the circular type shown in FIG. 6, having a diameter equal to the dimension of the square configuration. Thus the structure in square form which houses the flame arrester can be significantly smaller to provide an adequate flow area to meet a specific pressure drop requirement for a flame arrester. In a typical installation, this is either an essential or a very valuable consideration. That is to say, that if specific flow area for gases is required, the base dimension for the round unit would be about 1.7 times greater than for the square unit.

Those versed in the art know that in reference to circular passages or ports, a 5/32 inch port is not capable of suitable cooling, but for most gas-air mixtures a ⅛ inch port is capable of suitable cooling action if its lenth is great enough. But because a round port provides only 0.79 of the area of an equivalent square dimension, and since round ports must be separated a distance at least ½ a diameter, it is not considered suitable to make use of round ports in flame arrester structures as a general design. Furthermore, and in view of the commonly accepted requirement for port length to diameter ratio, which is of the order of 100/1, it is not possible to make use of ⅛ inch diameter passages in the typical flame arrester.

It becomes obvious that a slot is the preferable passageway because of lack of obstruction, but as slots are considered it is pointed out that a ⅛ inch wide slot does not have a cooling effect equal to a ⅛ inch round port. It is necessary to diminish the width of the slot at least to 3/64 inch to obtain equivalent cooling effect. It is also necessary to avoid the use of a straight slot across the full width of the flame arrester structure for entry of the gas mixture. Consequently, the width of the laminae is broken up into a plurality of channels which form short slots of length C when the laminae are nested together. The dimension C is normally in the range of ¼ to 2 inches.

What has been described is an improved type of flame arrester structure which has greater space efficiency than the conventional and has lower pressure drop for a required flow of gas mixture.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

I claim:

1. A flame arrestor for use in passage-ways for combustible oxidant/fuel mixtures compriseing:

a. a housing of rectangular cross-section of selected values of internal cross-sectional width W and length L, and having a selected height H parallel to the direction of flow of said mixtures;

b. a plurality of substantially identical planar laminae stacked in parallel continguous contact within said housing along the entire internal length L of said housing;

c. each lamina having a width W and height H and formed with a plurality of spaced-apart, parallel, shallow, rectangular channels, parallel to and extending the length of said height dimension H, said channels of selected depth D and width C, said laminae being so stacked as to form a plurality of substantially equal sized narrows slots for gas flow, said slots of width D and length C for a distance H in the flow direction.

2. The flame arrester as in claim 1 in which said dimension D is substantially 3/64 inch.

3. The flame arrester as in claim 1 in which said dimension C is in the range of ¼ to 2 inches.

4. The flame arrestor as in claim 1 including spacers in the said channels of said lamina of dimension D.

5. The flame arrester as in claim 4 in which said spacers comprise protrusions formed in the sheet of said lamina.

6. The flame arrester as in claim 4 including at least two spacers in each channel at different distances from each end.

* * * * *